United States Patent [19]

Bisk

[11] 3,980,228

[45] Sept. 14, 1976

[54] PLASTIC HANGER

[76] Inventor: Max Bisk, 1100 Elbridge St., Philadelphia, Pa. 19111

[22] Filed: Aug. 14, 1975

[21] Appl. No.: 604,679

[52] U.S. Cl. ..... 223/88
[51] Int. Cl.[2] ..... A47J 51/091
[58] Field of Search ..... 223/88, 85, 91; 211/113, 105.1, 105.3, 105.5, 123

[56] References Cited

UNITED STATES PATENTS

| | | | |
|---|---|---|---|
| 2,306,254 | 12/1942 | Quackenbush | 223/88 X |
| 2,392,080 | 1/1946 | Baldanza et al. | 223/92 |
| 2,568,674 | 9/1951 | Wieder | 223/91 |
| 3,269,553 | 8/1966 | Ruhnke | 211/105.1 |

FOREIGN PATENTS OR APPLICATIONS

| | | | |
|---|---|---|---|
| 569,362 | 5/1945 | United Kingdom | 223/88 |

*Primary Examiner*—George H. Krizmanich
*Attorney, Agent, or Firm*—Caesar, Rivise, Bernstein & Cohen, Ltd.

[57] ABSTRACT

A garment hanger having a first member with a pair of shoulders which extend in opposite directions laterally from the hook member. The shoulders also extend downwardly from the support member and each have at the free end thereof a fastening element. A trouser bar is provided which is elongated and has at each end thereof a fastening element which enables securement of the trouser bar to the first member by aligning the fastening elements of the trouser bar with the fastening elements of the shoulder and pressing the elements together whereby the bar is snapped together with the first member.

5 Claims, 6 Drawing Figures

FIG. 4
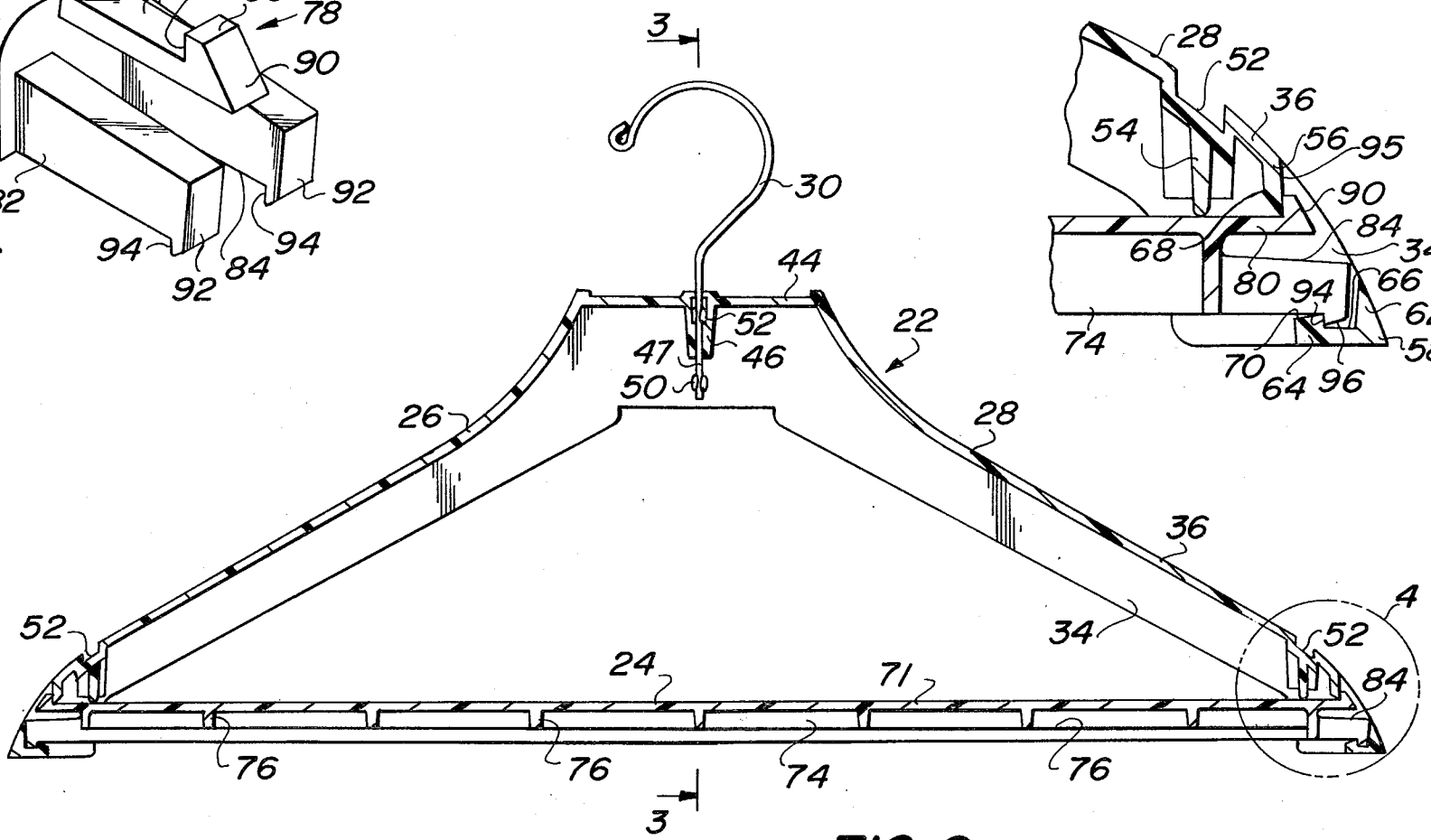
FIG. 2
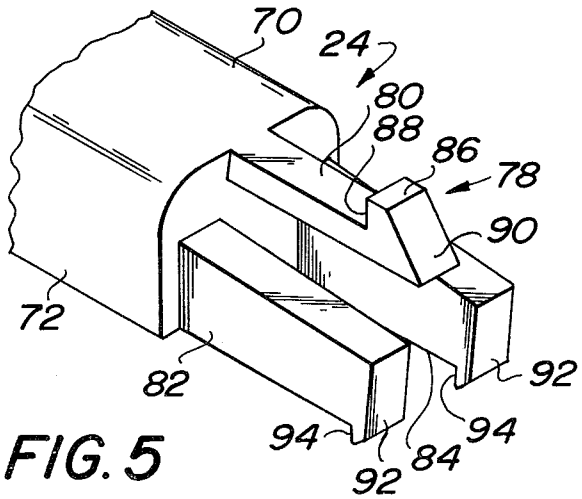
FIG. 5

PLASTIC HANGER

This invention relates generally to garment hangers and more particularly to a plastic garment hanger.

Straight or flat hangers are normally used where space is a very important consideration. That is, wishbone hangers which project not only laterally of the hook member but also forwardly at the ends in order to shape the jacket supported thereby take up more space than the straight hanger. For durability and attractiveness, the most preferred straight hangers have been made of wood. However, with the cost of wood having skyrocketed in the past few years, alternative sources have been sought. However, attempts to make straight hangers from plastic and other inexpensive materials have resulted in straight hangers which are either unattractive or not durable. Where these straight hangers have been inexpensive they have been unattractive as well as not durable.

It is therefore an object of this invention to overcome the aforementioned disadvantages of the prior art.

Another object of the invention is to provide a new and improved garment hanger which has an attractive appearance yet which is inexpensive to manufacture.

Yet another object of the invention is to provide a new improved garment hanger which includes a coat or jacket support member and a trouser bar member which are snapped together for ease of manufacture.

These and other objects of the invention are achieved by providing a garment hanger having a first member with a pair of shoulders which extend in opposite directions laterally from a supporting member. The shoulders also extend downwardly from the support member and each have at the free end there a fastening element. A trouser bar is provided which is elongated and has at each end thereof a fastening element. The trouser bar is secured to the first member by aligning the fastening elements of the trouser bar with the fastening elements of the shoulder and pressing the elements together. The fastening elements are fixedly secured by a snapping action.

Other objects and many of the attendant advantages of this invention will be readily appreciated as the same becomes better understood by reference to the following detailed description when considered in connection with the accompanying drawings wherein:

FIG. 2 is an enlarged sectional view taken along the line 2—2 in FIG. 1 showing the plastic hanger in sectional elevation with the hook member shown in full for purposes of clarity;

FIG. 4 is an enlarged sectional view taken with the circle 4 in FIG. 2;

FIG. 5 is an enlarged fragmentary perspective view of a fastening element at the end of the trouser bar.

Figure 1:
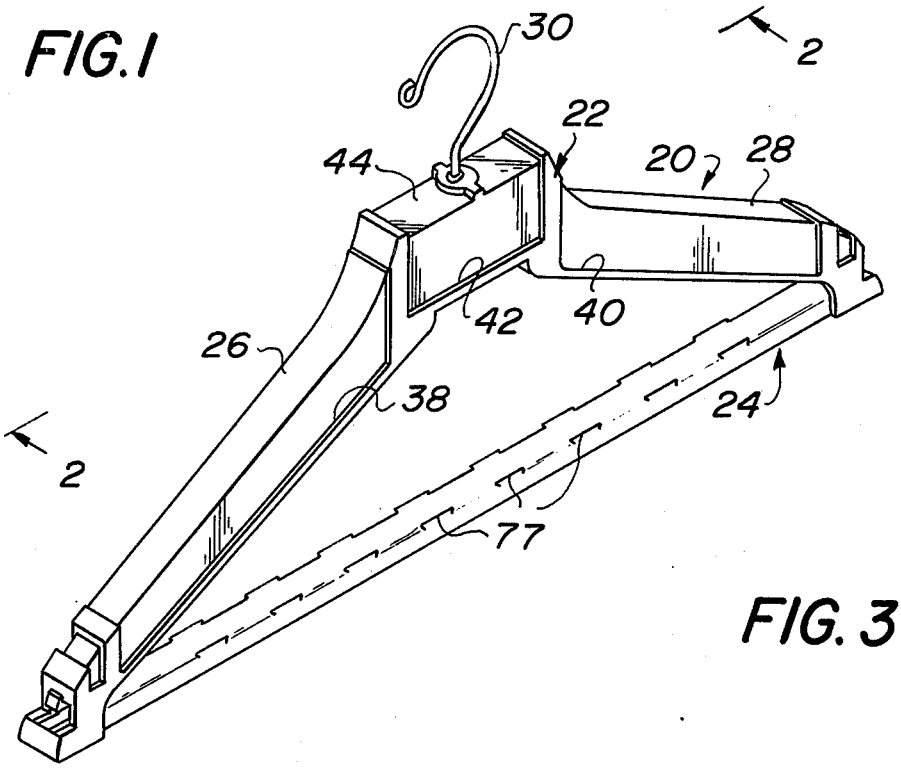
FIG. 1 is a perspective view of a preferred plastic hanger embodying the invention.

Referring now in greater detail to the various figures of the drawing wherein like reference numerals refer to like parts, a plastic hanger embodying the invention is shown generally at 20 in FIG. 1. Plastic hanger 20 basically comprises a coat or jacket member 22 and a trouser bar 24. The member 22 includes a pair of shoulder members 26 and 28 which extend in opposite directions laterally from a support or hook member 30.

Figure 3:
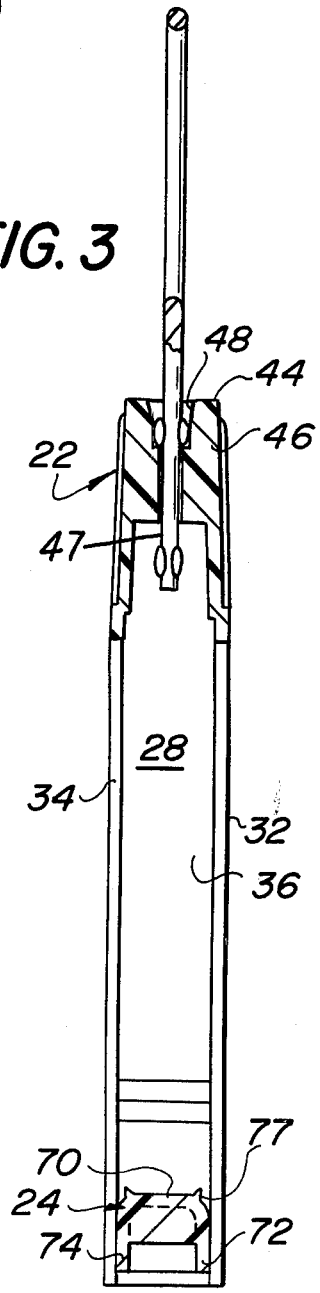
FIG. 3 is an enlarged sectional view taken along the line 3—3 in FIG. 2.

As best seen in FIG. 2, the jacket member 22 is substantially hollow and the shoulders 26 and 28 basically comprise a U-shaped shell cross-sectionally as best seen in FIG. 3. Thus, each of the shoulders 26 and 28 include a front wall 32, a rear wall 34 and a bridging wall 36. The bridging wall 36 runs over the top surface of the jacket member. As best seen in FIG. 1, the outer surface of shoulders 26 and 28 have recessed portions 38 and 40 and a generally rectangular recessed portion 42 which extends between the shoulders 26 and 28 which extend from front to rear which are provided for ornamental purposes. The uppermost portions of shoulders 26 and 28 form a rectangular planar portion 44 in which the hook member 30 is secured. As best seen in FIGS. 2 and 3, the straight portion 44 includes a socket member 46 which extends between the front and rear walls 32 and 34 and has a vertically extending opening which extends along the entire vertical length of the socket member 46. At the uppermost end of the vertical opening in socket member 46 is an enlarged portion 48 in which the straight portion 47 of hook member 30 is inserted.

The hook member 30 includes a pair of swaged portions 50 and 52 which are enlarged diametrically thereat and which maintain the hook member within fixed vertical limits position with respect to the straight member 44 of the coat member 22.

Members 22 and 24 are preferably comprised of a general purpose polypropylene and are formed by injection molding. As soon as the member 22 is formed, the hook member 30 has the straight portion 48 thereof inserted in the opening at the wider end 48 and through the socket member 46 until the swaged portion 50 extends beyond the end of the socket member 46. As the member 22 is cooled, the socket becomes harder thereby locking into place the hook member 30 as shown in FIG. 2.

The ends of the shoulder members 26 and 28 are best seen in FIG. 4. As seen therein, the top wall 36 of the shoulder members 26 and 28 include a deep recess 52 which has as its purpose a hooking portion for the shoulder straps of women's dresses. Directly below the recess 52 is a rib 54. The rib member 54 extends between the front and rear walls 32 and 34, is integral therewith and provides structural rigidity to the ends of the shoulder members 26 and 28. The top wall 36 of the shoulder members 26 and 28 at the end thereof extends vertically down to form an end flange 56 in the top wall 36 of the shoulder members.

The endmost portion of the shoulders 26 and 28 include a bridging member 58 which extends between and is integral with the front and rear walls 32 and 34, respectively, of the member 22. The bridging member 58 is generally rectangular at its base and includes a pair of upwardly extending projections 60 and 62 which have formed therebetween a recess 66.

It should be noted that the bridging member 58 is spaced vertically from the flange 56 and rib 54 to provide a horizontally extending opening or socket which acts as a fastening element for the securement of the trouser bar 24 to the jacket member 22.

Flange 56 includes a cam surface 68 and the top surface of projection 64 is also cammed at 70 to provide a smooth inserting inlet for the socket formed of flange 56 and bridging member 58. The recess 66, as will hereinafter be seen, acts as the locking recess for hook members provided on the fingers of the fastening elements of the trouser bar 24.

As best seen in FIG. 2, the trouser bar 24 is elongated, disposed horizontally and extends between the lateralmost ends of the shoulders 26 and 28 of the jacket member 22. The trouser bar 24 basically comprises a hollow top wall member 71 which bridges a front wall 72 and a rear wall 74 and is integral therewith.

The trouser bar further includes a plurality of ribs 76 which extend transversely to walls 72 and 74 and are integral therewith and which are provided for structural stability. On the top surface of top wall 71, a plurality of sharp projections or engaging members 77 are provided at spaced intervals. The engaging members act to increase the frictional engagement between the bar and trousers to prevent slipping.

As best seen in FIG. 5, a fastening element 78 is provided at each end of the trouser bar 24. Fastening element 78 basically comprises a plurality of fingers 80, 82 and 84. Each of the fingers 80, 82 and 84 have hooking members at the end thereof. That is, finger 80 includes an enlarged portion 86 which forms a hooking member having a shoulder 88 and a front cam surface 90.

The end members 92 on each of the fingers 80, 82 and 84 form hooking members having a pair of shoulders 94 which face towards the center of the bar and also include a cam surface 96. The cam surfaces 90 and 96 on fingers 80, 82 and 84 act to enable the fingers to be inserted into the socket formed at the end of each of the shoulders 26 and 28. That is, as the fastening element 78 is pressed inwardly against the fastening element comprising the socket in the shoulder members, the fastening elements are abutted at the cam surfaces thereof.

The engagement of cam surface 68 by cam surface 90 on finger 80 and the engagement of the cam surfaces 96 by cam surfaces 70 acts to urge the fingers 80 towards fingers 82 and 84 of fastening element 78. This causes the fastening element to be able to pass the socket formed by flange 56 and projection 64. As soon as the enlarged ends of the fingers pass the flange 56 and projection 64 the finger 80 snaps away from fingers 82 and 84 and thereby causes the shoulders 94 of the enlarged portions 92 of fingers 82 and 84 to be lodged in recess 66 of bridging member 58 and the shoulder 88 of enlarged member 86 to abut the outer surface 95 of flange 56. After the first end of the trouser bar 24 is inserted into one of the fastening elements formed at the ends of the jacket member 22 the remaining fastening element at the other end of the trouser bar 24 is aligned with the other socket element at the other end of the jacket member 22 and the second element of the bar is inserted into the second socket element of the jacket member 22 to assemble the plastic hanger. It should be noted that member 22 is slightly resilient so that the ends can be spaced far enough apart to insert the second fastening element of bar 24.

Figure 6:
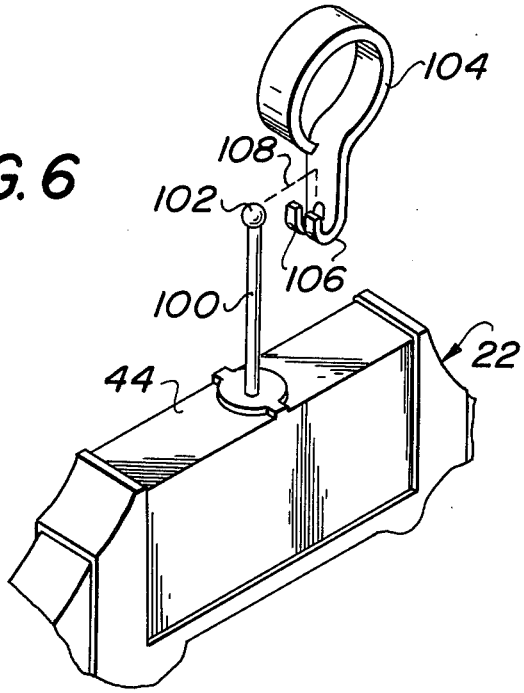
FIG. 6 is a fragmentary perspective view of a plastic hanger embodying the invention having an alternate support member.

Referring to FIG. 6, it can be seen that an alternate support member can be used with the plastic hanger embodying the invention. That is, a support member 100 is utilized in place of a hook member 30 which has a straight portion like straight member 47 of hook 30 which extends through the socket 46 of the straight portion 44 of the jacket member 22. The support member 100 includes an enlarged ball 102 at the end thereof which is utilized in combination with a bracket

104 which is slidably fixed in place in most hotel rooms. The support member 100 is usually provided in hotels where theft of hangers is a considerable problem. This enables a hotel to utilize a hanger of distinctive quality while preventing loss thereof due to theft since the support member 100 is useless without the bracket 104. The bracket 104 includes a pair of fingers 106 which are spaced from each other and provide a socket for receipt of the ball 102 at the end of support member 100. The ball 102 rests in the bridging portion of the U-shaped fingers 106 when the support member is utilized in a storage position. To remove the garments from the hanger requires only that the support member 100 be lifted in a conventional fashion and removed from the U-shaped fingers 106 along the dotted line 108 shown in FIG. 6.

It can therefore be seen that a new and improved straight hanger has been provided.

The hanger is not only attractive, but can be inexpensively manufactured because of the unique fastening elements used for securing the trouser bar to the jacket member 22. In addition, efficient techniques for securing the hook members or support members to the jacket member are also utilized. The attractiveness of the hanger is enhanced by a molded member which includes not only a top wall but also front and side walls which add to the solid look of the jacket member 22.

The trouser bar also is molded to include a top and side walls which are enhanced as a support for trousers by the barbs 77 which are spaced along the length of the top surface of the trouser bar 24 to engage frictionally the trouser as it is folded over the top surface of the trouser bar 24.

Without further elaboration, the foregoing will so fully illustrate my invention that others may, by applying current or future knowledge, readily adapt the same for use under various conditions to service.

What is claimed as the invention is:

1. A garment hanger having a first member with a pair of shoulders which extend in opposite directions laterally from a supporting member, said shoulders also extending downwardly from said support member and each having at the free end thereof a fastening element, and a trouser bar, said bar being elongated and having at each end thereof a fastening element, each of said shoulders being hollow and of U-shaped cross-section including a front, rear and top wall, each of said fastening elements of said shoulders including a bridging member extending between the front and rear walls of said shoulders at the end thereof, and an opening formed by the termination of said top wall at a point intermediate of the end of said shoulder, said top wall having a flange at said intermediate portion which extends between said front and rear wall so that a socket is formed between said flange and said bridging member, said trouser bar being secured to said shoulder by insertion of the ends of said trouser bar into said openings with said ends of said trouser bar being supported by said bridging members.

2. The garment hanger of claim 1 wherein said trouser bar includes a plurality of engaging members spaced along the upper surface of said bar.

3. The garment hanger of claim 1 wherein said support member comprises a hook for securement of the hanger to a supporting bar.

4. A garment hanger having a first member with a pair of shoulders which extend in opposite directions laterally from a supporting member, said shoulders also extending downwardly from said support member and each having at the free end thereof a fastening element, and a trouser bar, said bar being elongated and having at each end thereof a fastening element, each of said shoulders being hollow and of U-shaped cross-section including a front, rear and top wall, each of said fastening elements of said shoulders including a bridging member extending between the front and rear walls of said shoulders at the end thereof, and an opening formed by the termination of said top wall at a point intermediate of the end of said shoulder, said top wall having a flange at said intermediate portion which extends between said front and rear wall so that a socket is formed between said flange and said bridging member, said trouser bar being secured to said shoulder by insertion of the ends of said trouser bar into said openings, said trouser bar including at each end thereof a plurality of fingers, said fingers forming said fastening elements, one of said fingers being disposed at the upper end of an end wall of the trouser bar with a pair of fingers being provided below said one finger, each of said fingers having a hooking member which includes a cammed surface on its outer edge, said socket formed by said bridging member and said flange including a cammed surface on each of said flanges and bridging member elements so that insertion of the fastening element of said trouser bar causes said fingers to be urged together as they enter the socket of said shoulder, after said fingers are inserted to a predetermined depth, said fingers snap apart to lock an end of the trouser bar in the socket of said shoulder.

5. The garment hanger of claim 1 wherein there is provided at the end of each of said shoulders a recess in the top wall which is adapted to be used to secure the straps of women's dresses.

* * * * *